US009828208B2

(12) United States Patent
Barea

(10) Patent No.: US 9,828,208 B2
(45) Date of Patent: Nov. 28, 2017

(54) METHOD AND SYSTEM FOR FEEDING A THREAD TO A TEXTILE MACHINE, AT A CONSTANT TENSION AND PRESET DRAW, AS A FUNCTION OF THE OPERATING STEP OF THE LATTER

(71) Applicant: BTSR INTERNATIONAL S.P.A., Olgiate Olona (Varese) (IT)

(72) Inventor: Tiziano Barea, Busto Arsizio (Varese) (IT)

(73) Assignee: BTSR INTERNATIONAL S.P.A., Olgiate Olona (Varese)

( * ) Notice: Subject to any disclaimer, the term of this patent is extended or adjusted under 35 U.S.C. 154(b) by 350 days.

(21) Appl. No.: 14/431,226

(22) PCT Filed: Oct. 11, 2013

(86) PCT No.: PCT/IB2013/059300

§ 371 (c)(1),
(2) Date: Mar. 25, 2015

(87) PCT Pub. No.: WO2014/068430

PCT Pub. Date: May 8, 2014

(65) Prior Publication Data

US 2015/0274482 A1 Oct. 1, 2015

(30) Foreign Application Priority Data

Oct. 30, 2012 (IT) ..... MI2012A1846

(51) Int. Cl.
*B65H 59/38* (2006.01)
*B65H 51/22* (2006.01)
(Continued)

(52) U.S. Cl.
CPC ..... *B65H 59/388* (2013.01); *B65H 51/02* (2013.01); *B65H 51/22* (2013.01); *B65H 51/30* (2013.01); *D02J 1/227* (2013.01); *B65H 2701/31* (2013.01)

(58) Field of Classification Search
CPC ..... B65H 51/02; B65H 51/22; B65H 51/30; B65H 59/388
See application file for complete search history.

(56) References Cited

U.S. PATENT DOCUMENTS 4,383,655 A * 5/1983 Ahrendt ..... B65H 51/22 242/364.11
5,791,542 A * 8/1998 Porat ..... B65H 59/387 226/118.2

(Continued)

FOREIGN PATENT DOCUMENTS

DE 4010586 C1 6/1991
DE 19916607 A1 10/1999

(Continued)

OTHER PUBLICATIONS

International Search Report and Written Opinion mailed Feb. 4, 2014 for PCT/IB2013/059300 to BTSR International S.P.A. filed Oct. 11, 2013.

*Primary Examiner* — Shaun R Hurley
(74) *Attorney, Agent, or Firm* — Vorys, Sater, Seymour and Pease LLP

(57) ABSTRACT

A method for feeding a thread at a preset drawing to a textile machine includes a first feeder which sends the thread to the textile machine and a second feeder arranged spaced from the first feeder and which sends such thread to the latter, each feeder having a rotary member on which there is partly wound the thread before the feeding thereof and a speed sensor adapted to detect the rotational speed of such rotary member and a tension sensor to detect the tension of the thread exiting from each feeder. Controlling drawing the thread sent to the textile machine by controlling and adjusting the ratio between the rotational speed of the rotary member of the first feeder and the rotational speed of the rotary member of the second feeder.

20 Claims, 1 Drawing Sheet

(51) Int. Cl.

| | |
|---|---|
| ***B65H 51/30*** | (2006.01) |
| ***D02J 1/22*** | (2006.01) |
| ***B65H 51/02*** | (2006.01) |

(56) References Cited

U.S. PATENT DOCUMENTS

| | | | | |
|---|---|---|---|---|
| 2008/0210804 | A1 | 9/2008 | Barea | |
| 2011/0006096 | A1 | 1/2011 | Barea | |
| 2013/0056573 | A1 | 3/2013 | Barea | |
| 2013/0119177 | A1* | 5/2013 | Barea | B65H 51/22 242/365.7 |
| 2014/0084101 | A1* | 3/2014 | Barea | B65H 59/388 242/419 |
| 2014/0291435 | A1* | 10/2014 | Barea | D04B 15/482 242/417 |
| 2016/0060074 | A1* | 3/2016 | Bing-Wo | B65H 59/388 242/563 |

FOREIGN PATENT DOCUMENTS

| | | | |
|---|---|---|---|
| EP | 0950742 | A2 | 10/1999 |
| WO | 2007006411 | A1 | 1/2007 |
| WO | 2009112221 | A1 | 9/2009 |
| WO | 2011144987 | A1 | 11/2011 |

* cited by examiner

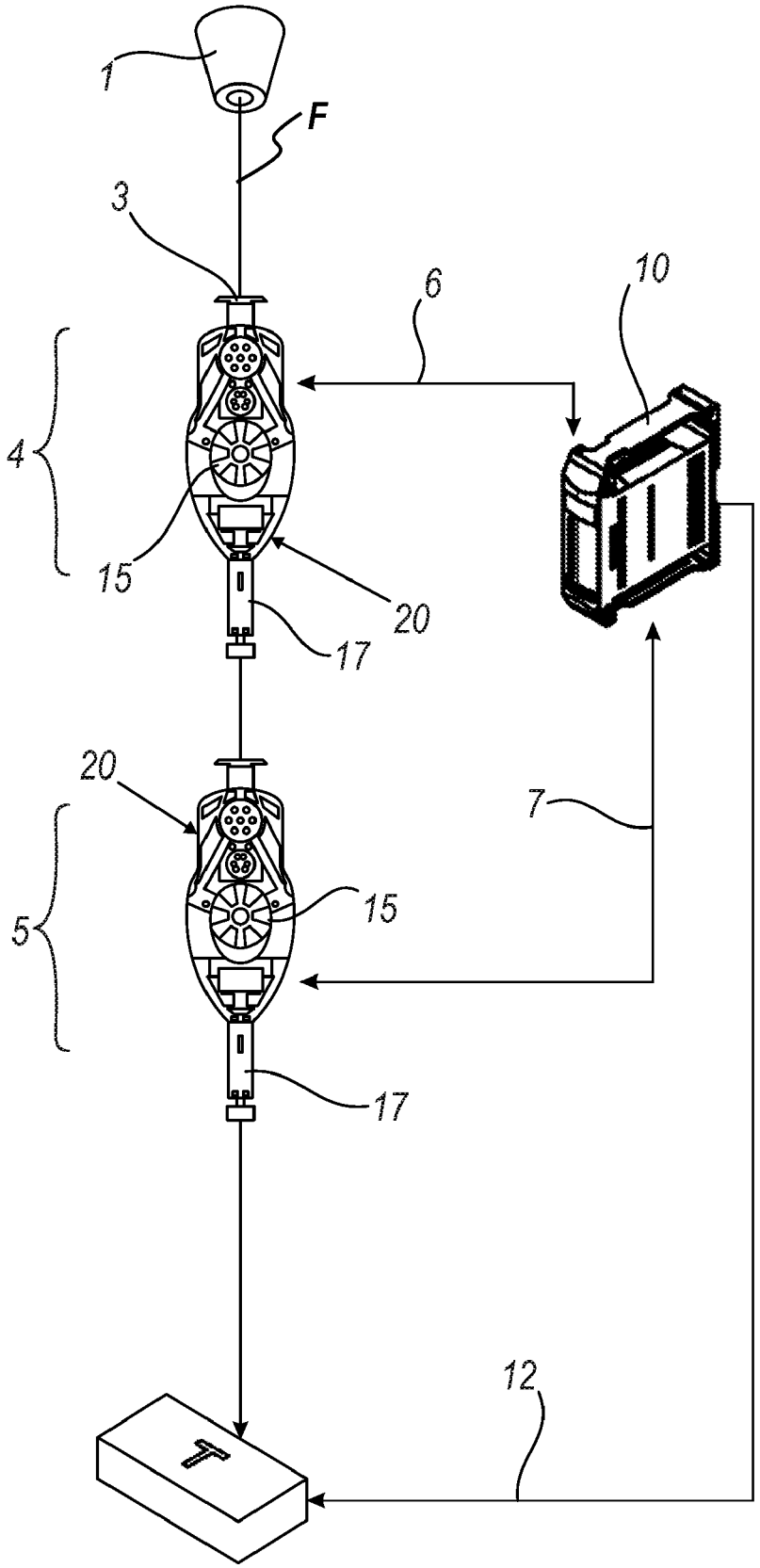
1
F
3
6
10
4
15
20
17
20
7
5
15
17
12

METHOD AND SYSTEM FOR FEEDING A THREAD TO A TEXTILE MACHINE, AT A CONSTANT TENSION AND PRESET DRAW, AS A FUNCTION OF THE OPERATING STEP OF THE LATTER

CROSS-REFERENCE TO RELATED APPLICATIONS

This is a §371 National Stage Application of International Application No. PCT/IB2013/059300 filed on Oct. 11, 2013, claiming the priority of Italian Patent Application No. MI2012A001846 filed on Oct. 30, 2012.

BACKGROUND

A method for feeding, at a constant tension and preset drawing ratio, a thread to a textile machine as a function of the operating step of the latter, forms an object of the present invention. A system for the implementation of the method mentioned above also forms an object of the present invention.

Various types of feeder devices and corresponding operating methods capable of feeding a thread to a textile machine controlling the tension and keeping it constant during the machining process thereof are known to a man skilled in the art. Generally such feeders have a main body which comprises a pulley on which there is wound the thread picked up by a spool, such pulley being actuated by an actuator or electric motor, controlled by an electronic control unit to which there is connected a tension sensor, for example a loading cell. The electronic control unit, as a function of the tension of the measured thread, commands the aforementioned motor accelerating or decelerating the rotational speed of the pulley and thus the speed of the thread, thus being able to control the tension thereof, uniforming it to a preset value.

This family of feeders has the major advantage of not requiring any synchronisation with the textile machine: actually, the device, continuing to measure the tension of the thread is not only capable of controlling the tension thereof during the feeding step but also starting and ending the feeding step in an entirely automatic manner.

Various types of feeder devices (and corresponding operating methods) capable of feeding a thread to a textile machine controlling the speed thereof and keeping it constant during the process are also known to a man skilled in the art. Generally, such feeders are similar to those mentioned further above, but they comprise speed detection means associated to the rotary pulley (still actuated by an electric motor thereof). An electronic control unit is connected to such detection means with the aim of keeping the rotational speed of the pulley (on which the thread is bound) constant. This is obtained as a function of the speed data detected by such means and acting on the aforementioned motor.

This family of feeders has the major disadvantage of requiring an accurate synchronisation with the textile machine: actually, the device compulsorily operates in "electrical axis" with the machine (i.e. as a function of the speed of the latter) given that the speed of the fed thread is as a function of the amount of thread picked up by the machine.

This particularly complicates the step of starting and stopping the feeding and thus the programming thereof; an error when setting the ratio between the aforementioned speed and the pick up speed of the machine may actually lead to the breaking of the thread.

Devices for drawing the thread, for example used on draw-winding machines in the yarn preparation industry are also known. Such devices are generally made up of two pulleys (or rollers) on which the thread is wound; they are positioned in a cascading fashion and they are controlled by an electronic unit which controls the rotation speed thereof with the purpose of maintaining an accurate ratio between the two speeds thereof and thus controlling the drawing ratio of the fed thread. Regarding this, it should be observed that the drawing ratio or simply "draw" is usually defined as $R=V\mathbf{1}/V\mathbf{2}$, where V1 is the speed with which the machine picks up the thread and V2 the speed of the thread entering into the second roller.

Thus, a drawing device is actually made up of two feeders at a constant speed and obviously it reveals the same drawbacks related to the required synchronisation with the textile machine mentioned further above.

Processes for producing products which provide for, within the same item, the use of the same type of thread (nylon), but with different counts depending on the area of the product being produced are known. This with the aim of obtaining particular effects (greater compactness, transparency, . . . ). For example, from an application point of view there is known the process of producing pantyhose stockings on circular machines, with small and medium diameter, in which there are generally used two types of thread: the first generally with higher count (for example 28 dtex) for obtaining the body and a second lower count (for example 18 dtex) for obtaining the leg. Thus, such machine should provide for a casing (or creel) capable of housing two reels (one for each part of the product—for example body and leg) for each drop and thus here should be provided for the possibility of selecting, through the appropriate thread guide, the thread to be used as a function of the production process during the actuation (i.e. the part of product being produced).

This need obviously forces the manufacturer to have a warehouse with a wide range of thread counts so as to meet the various productions needs (for example, for producing stockings of different thinkness).

EP1901984 on behalf of the same Applicant describes a method for feeding, at a constant tension, a thread to a processing point of a textile machine (such as for example a machine for manufacturing diapers) far from the reel or equivalent supporting member from which the thread is unwound. The thread is controlled tension-wise in proximity of the reel so as to measure the tension of such thread and control and adjust such parameter to a first predetermined tension value at the beginning of the use by the textile machine immediately upon unwinding the thread from the reel. Second means for measuring the tension are arranged in proximity of the textile machine from which there is obtained the information for setting the operating tension in proximity of the reel; this allows obtaining a desired tension at the machine. This based on a comparison made between the thread tension measured at the entry of the latter and a second predetermined tension value, said comparison being such to maintain said measured tension constantly equal to said second predetermined value over the entire duration of use of the machine.

The aforementioned patent text, regarding this known solution, describes a method and a corresponding device which allow overcoming the problem of uniforming, to a set value, the tension of the thread at the second measurement means, but it is not capable of compensating different subsequent frictions to such tension measurement means, various functions for example due to the use of glue applying device on the machine for manufacturing diapers or thread guides of a circular machine. The different frictions downstream of the machine would thus lead to an increase of the tension with ensuing drawing of the thread (particularly evident with elastic yarns). Thus, in a plurality of threads on which the textile machine operates, the latter could all have the same tension, but be fed with different speeds (the thread is drawn proportionally to the friction tension not compensated by the system due to the fact that it is generated downstream of the second tension sensor) to the machine, thus deteriorating the final quality of the finished product.

SUMMARY

An object of the present invention is to provide a method and a system for feeding, at a constant tension, at least one thread to a textile machine and which is capable of maintaining the drawing ratio constant during such feeding.

In particular, an object of the present invention is to provide a method and a system for feeding, at a constant tension, a thread to a textile machine, said feeding occurring with a preset drawing ratio as a function of the operating step of the machine.

A further object of the invention is to provide a system of the aforementioned type in which the drawing ratio of the thread can be programmed, said system being able to maintain such ratio constant and uniform at a preset value during the operation; this as a function of the various operating steps of the machine, in particular so as to simplify the start and stop step of the textile machine or to obtain particular effects on the finished product produced by the textile machine.

Another object is to provide a system of the aforementioned type capable of operating without requiring any synchronisation with the textile machine to which it is associated thus allowing applying such solution also to machines previously existing in the market.

A further object is to provide a universal system capable of allowing automatically performing the draw-reeling both during a process for preparing-machining a thread/yarn (re-winding machines, texturising machines, weft winders, . . . ) and machines that use threads/yarns for producing products (circular machines, small, medium, large diameter, or frameworks).

A further object is to provide a method and a thread drawing system of the aforementioned type, which allows drawing a thread when it is used for producing a product, thus allowing eliminating a preventive draw-winding production process and reducing times as well as costs of the production process.

Another object is that of providing a drawing system of the aforementioned type capable of feeding the thread at a constant tension and which can be programmed, possibly variable as a function of the various operating steps of the machine (facilitating the start, graduation of the tension, . . . ).

Another object is that of providing a drawing method and system of the of the aforementioned type capable of guaranteeing the constancy of the process which allows intercepting possible malfunctions during the production of the product such as for example the breakage of the thread or variation of the set parameters (such as the tension of the thread or the drawing value).

A particular object of the invention applied to the seamless stockings production industry is to provide a system which allows such production using a single thread or a limited type of threads to be kept in the warehouse and on the creel of the stockings manufacturing machine, the variations of count upon the variation of the thickness of the stocking and upon the variation of the operating step (body, leg) being obtained by programming different drawing values upon variation of the item and the various operating areas of the machine with the ensuing reduction of storage costs, setting the machine and considerable increase of the flexibility and efficiency of the machine by eliminating an error risk related to the steps of changing the thread guide of such machine and the required deceleration and ensuing acceleration ramp during such change (with ensuing lesser period of production and thus higher productivity).

Another object is that of providing a system of the aforementioned type that is capable of varying the drawing ratio to obtain particular effects on the stocking (such as greater transparency, for example . . . ).

These and other objects which are clear to a man skilled in the art are attained by a method and a corresponding system according to the attached claims.

BRIEF DESCRIPTION OF THE DRAWINGS

The following drawings are attached to the present invention, purely by way of non-limiting example for a better understanding of the present invention, wherein:

FIG. 1 shows an entirety view of a system according to the invention.

DETAILED DESCRIPTION

With reference to the aforementioned FIG. 1, a system according to the invention (adapted to implement the method according to the invention), is used for controlling the feeding of a thread F to a textile machine T, said thread F being unwound from a reel 1.

Upon detachment from the reel 1, the thread F passes through a common thread guide 3 and reaches a first feeder 4 which feeds such thread at a constant tension towards a second feeder 5 which feeds such thread, still at a constant tension towards the textile machine T. The feeders 4 and 5 are spaced from each other and they are both connected, through a corresponding serial connection or bus 6 and 7, to a control unit 10, preferably with a microprocessor, which coordinates and controls the operation thereof. Such unit 10 may be (like in the case of FIG. 1) connected or not connected to the textile machine T through a bus 12.

The feeders 4 and 5 are preferably equally per se known. For example, they are analogous to the thread feeding device described in EP950742 or in EP2262940 or in WO2011144987 on behalf of the Applicant, at least as regards the elements constituting the feeders 4 and 5.

More in particular, each feeder 4 and 5 comprises a rotary element or pulley 15 on which there is wound the thread F (the thread is at least partly wound on such element or, preferably, it performs several turns on itself so as to avoid slipping on the latter); such rotary element 15 is constrained and moved by an actuator thereof or electric motor (not shown) for example of the brushless type. The motor is controlled and commanded by the unit 10.

The pulley 15 cooperates with a common speed sensor (not shown) such as a Hall sensor, an encoder or the like (preferably integrated in the motor) connected to the unit 10 and through which such unit detects the thread feeding speed and adjusts it.

Each apparatus 4 and 5 is provided with a tension sensor 17 capable of measuring, in real time and with absolute precision, the tension of the thread F during the feeding step.

The unit 10, in particular, commands the motors of the pulleys 15 acting on an electronic control associated to a body 20 of each apparatus 4 and 5. Through such electronic control, to which there are associated the sensors or means for accurately measuring the rotational speed of the motor, the unit 10 obtains information regarding the speed of each pulley 15 and the thread associated thereto. Obviously, as regards the electronic control (on board the feeders 4, 5 and connected to the unit 10) measuring and controlling the rotational speed of the respective pulley is also capable of directly measuring the amount of thread fed to the textile machine with absolute precision (given that the feeding of the thread to such machine occurs in absence of slipping of the thread itself on the pulley 15).

The feeders 4 and 5 are actually two feeders capable of both operating at a constant tension and at a constant speed, operating methods well known to those skilled in the art and summarised hereinafter.

In the constant tension operating mode, the electronic control, associated to each feeder, continues measuring the thread tension through the sensor 17 and, as a function of the read value, modifies the speed of the motor by acting on the pulley 15 (and thus that of the latter) so as to allow maintaining (according to algorithms P, PI, PID per se known) the tension of the thread F uniformed with a preset value (or setpoint); such value, possibly programmable, may be fixed or it can be varied during the machining, for example as a function of the various operating steps of the machine. In particular, when the measured tension exceeds the preset setpoint tension value, the electronic control increases the speed of the pulley 15 and thus that of the thread; vice versa, when the measured tension value is below the setpoint value, the motor is slowed. Obviously, during such operating mode the aforementioned electronics may measure the thread speed and thus the amount of fed thread (or LFA).

In the constant speed work mode, the electronic control "on board" each feeder continues measuring the speed of the motor by operating on the pulley 15 and allows (according to algorithms P, PI, PID per se known) uniforming said value to a preset value (or setpoint), possibly programmable; such value may be fixed or it may be varied during the operation, for example as a function of the various operating steps of the machine. Obviously, during this operating mode the aforementioned electronic control may simultaneously measure the tension of the thread F, through the sensor 17 to verify the development thereof and possibly signal malfunctions (i.e. if the tension of the thread is outside a preset bracket, possibly programmable, fixed or variable, for example, as a function of the various operating steps of the machine).

According to the invention, the system described above can feed, according to the method object of the invention, the thread F at a constant tension and with preset drawing ratio or at a constant speed and predefined drawing ratio. Herein below there shall be described the operating modes of the aforementioned system obtained by varying the configurations of the feeders 4 and 5 and the control unit 10.

In the constant tension drawing mode in which the drawing ratio is maintained equivalent to a predefined value, the feeders 4 and 5 operate in constant tension feeding mode.

As regards parameters, the tension of the thread F exiting from the system (or from the feeder 5) and the desired drawing value are programmed. It should be observed that the drawing ratio is usually defined as R=V1/V2, where V1 is the speed at which the machine picks up the thread detected through the measurement of the speed of the feeder pulley 5 and V2 is the speed of the thread entering the pulley 15 of the feeder 4. The system according to the invention allows adjusting such drawing ratio by controlling the ratio between the speed of the motors of the pulleys 15 of the two feeders 4 and 5. Thus, hereinafter the values V1 and V2 shall refer to the speed of the motors, respectively of the feeder 5 (V1) and of the feeder 4 (V2).

The control unit 10, through the bus or serial connections 6 and 7, communicates with the feeders 4 and 5 and in particular receives information regarding the state of each one of them; in particular, the unit 10 verifies whether the feeder 4 is in the feeding step and thus whether the speed of the motor (or of the pulley thereof 15) different from zero or whether such motor inoperative.

When the unit 10 detects that the feeder 5 (or first feeder) is inoperative (the machine T is not producing), it programmes a predefined value as the tension setpoint for the (second) feeder 4, for example the first reference tension as the first feeder.

In the present description, by way of example, the feeder 5 closer to the textile machine T is indicated as the first feeder, the second feeder being the one farther from such machine.

When the textile machine T starts the production (this for example being detected by the unit 10 through the bus 12) and demands the thread from the system, the first feeder 5 detects an increase of the measured tension through the tension sensor 17 thereof and as soon as the value is greater than the set tension, the electronic control on board, starts adjusting the speed of the thread through the pulley 15 by using known algorithms P, PI, PID, with the aim of uniforming the read tension value to a preset value (or setpoint) and keeping constant over the entire duration of the operation of the machine T and equivalent to such preset setpoint value. The electronic control, with the aim of optimising the starting of the feeding and the start of the machine, cold start adjusting the speed of the motor of the pulley before the measured tension of the thread F fed by the feeder 5 exceeds the setpoint value, for example by simply studying the derivative of the tension (or the variation thereof over time). Obviously, as soon as the feeder 5 starts feeding the thread to the textile machine, the feeder 4 also detects an increase of the measured tension through the sensor 17 thereof and starts guiding the motor of the pulley thereof controlling the speed thereof with the aim of maintaining the tension of the thread F uniformed at a predefined value and programmed by the control unit 10.

As soon as the unit 10 detects that the feeders 4 and 5 have passed from the machine stop step to the feeding step (or that the textile machine T has started the production thereof), continuing monitoring the data regarding the speed of the motors and the relative pulleys 15 of the two feeders 4 and 5, it acts on the tension setpoint value of the second feeder 4 so as to uniform the drawing ratio to a predefined value.

In particular if the control unit 10 detects that the instantaneously measured drawing ratio (V1/V2) and calculated thereby (in a known manner) is greater than the set value and thus the rotational speed of the motor of the pulley 15 of the second feeder 4 needs to be reduced, it shall increase the tension of setpoint of such second feeder; vice versa, if the instantaneously measured drawing ratio (V1/V2) is lower than the set value the rotational speed of the aforementioned motor is increased, thus reducing the setpoint tension of the second feeder.

In order to allow maintaining the instantaneous drawing ratio uniformed to a preset value, the control unit (10) shall preferably use per se known control algorithms (P, PI, PID) suitably calibrated to allow the system to be capable of reacting quickly compensating possible errors and thus being able to maintain said value of the drawing ratio constant also during the acceleration and deceleration steps of the textile machine.

The control unit 10 preferably connected through the bus 12 to the textile machine is capable of communicating therewith through a field bus and/or analogue/digital inputs/outputs of the machine itself, thus transferring the operating status thereof and the data regarding the operating step being carried out (and thus regarding the start and the end of such step); such unit 10 may possibly signal alarms or possible malfunctioning to stop such machine or receive information therefrom (start/stop condition, working speed, operating step, . . . ).

Through this connection, the textile machine T may also modify the operating tension value and/or of the system drawing value (still obtained through the unit 10 operating on the feeders 4 and 5 according to the method described further above) as a function of the various operating steps, for example by increasing or reducing the drawing value at each cylindrical turn of the textile machine or at each rotation of a driving shaft thereof.

It is thus clear that a drawing system operating according to the method described above attains the objects of the invention given that:

a) it is a system capable of feeding a thread to the textile machine at a constant tension regardless of the feeding speed of the thread and which can thus be applied to all textile machines in which it is crucial to control the tension during the process so as to guarantee the quality of the finished product. The setting of the desired tension, constant or variable as a function of the various operating steps of the machine, occurs by setting the setpoint tension of the feeder 5;

b) it is a system capable of maintaining the draw of the thread constant during the process of producing the product by the textile machine. The drawing of the thread is set and obtained as a ratio between the feeding speed of the thread sent to the textile machine, which depends on the speed V1 of the motor of the pulley 15 of the first feeder 5 (the speed, once set, not varying given that it "depends" on the machine T), and the speed of the motor of the pulley of the second feeder 4, V2, the latter being varied by modifying the reference value in terms of the tension of such second feeder, as described previously. The setting of the draw is carried out and thus determined by the ratio between the two speeds (thus, the speed of feeding the thread F by the two feeders 4 and 5) and controlled through the operating tension of the second feeder;

c) it is a system capable of varying the count of the thread being processed by simply modifying the drawing setpoint as a function of the operating step of the machine thus being able to guarantee different counts for the various operating steps, for example as required when manufacturing pantyhose stockings and allowing saving considerably in terms of weight of the raw material (thread) used in the process (for example, the same count 28 dtex drawn to 18 dtex allows saving in terms of raw material equivalent to 36%).

It is thus clear that the increase of the setpoint tension of the second feeder 4 actually also increases the drawing of the thread during the production process, the tension present between the two feeders actually being directly proportional to the speed ratio (V1/V2) of the motors of the pulleys 15 thereof.

Obviously, this relation is also influenced by the elasticity of the thread. Actually, the speed difference between the two motors to attain the same drawing shall be greater in case of low elasticity yarns and lower in case of high elasticity yarns.

The described system does not require any synchronisation with the machine and it is thus capable of being applied on any type of machine, even those not predisposed, whether operating on a yarn or producing a product.

In case of feeding with the drawing mode at a constant tension and speed, the feeder 5 operates at a constant tension, while the second feeder 4 operates at a constant speed mode.

In terms of parameters, the tension of the thread exiting from the system and the drawing value are programmed. The control unit 10, through each connection or bus 6 and 7 continues communicating with the feeders 4 and 5 and in particular it receives information regarding the state of each one of them; in particular, the unit 10 verifies whether the feeder 5 is in feeding step and thus the speed motor and the relative pulley 15 thereof are different from zero or whether such motor is inoperative.

When the unit 10 detects that the first feeder 5 is inoperative (the machine is not operating), it programmes the value corresponding to speed zero as the speed setpoint for the second feeder 4.

When the textile machine starts the production and demands the thread from the system, the first feeder 5, through the sensor 17 thereof detects an increase of the measured tension and as soon as the value is greater than the set tension the on board electronic control starts adjusting the speed of the thread through the pulley 15, using known algorithms P, PI, PID, with the aim of uniforming the read tension value to a preset value (setpoint). The electronic control of the feeder 5, with the aim of optimising the start of the machine T, could start adjusting the speed of the motor of the pulley 17 before the measured tension exceeds the setpoint value, for example by simply controlling the derivative of the tension.

Obviously, as soon as the first feeder 5 starts feeding the thread to the textile machine T, the control unit 10 detects that the speed of the motor associated thereto is different from zero and calculates the speed at which the motor of the second feeder 4 should operate to guarantee the correct drawing ratio and thus set the new speed reference (or setpoint) for the motor.

Thus, during the step of feeding the thread, the control unit 10 continues reading the feeding speed of the first feeder 5, calculates the new speed reference for the motor of the second feeder 4 hence so as to programme it correctly with the aim of having the desired drawing ratio. The control unit 10 may also verify the development of the output tension at the second feeder 4 and, in case of malfunction, stop the machine or signal malfunctioning (for example verify whether the tension falls within a predefined and programmable range so as to guarantee and monitor the quality of the process). The control unit 10, connected—through the bus 12—to the textile machine, is capable of communicating therewith through such field bus and/or the analogue/digital inputs/outputs thereof, detecting the operating status thereof, the operating steps thereof and possibly signalling alarms or possible malfunctions so as to stop the machine or receive information from the machine itself (start/stop condition, operating speed, operating step or any other . . . ).

In addition, this connection allows the textile machine to modify the operating tension value and the system drawing value (through the unit 10) as a function of the various operating steps of the machine itself, for example by increasing or reducing the drawing value at each turn of the cylinder of the textile machine or at each rotation of the driving shaft thereof.

It is thus clear that the drawing system according to the invention operating as described attains the objects of the invention as indicated further above.

Two embodiments of the invention have been described. However, variants may be provided for. For example, the control unit 10 may be integrated in one of the two feeders 4, 5 or, it may be integrated within the textile machine to which the feeders are connected.

It may also be provided for that the control unit 10 and the two feeders 4 and 5 be combined in a single device.

The unit 10 may be connected to the feeders and/or to the textile machine T in wireless mode; such control unit may provide for a display and keyboard for programming data and displaying information regarding the process of feeding the thread with uniformed draw at a preset value. However, the feeders may also provide for a display for displaying data and programming parameters.

Obviously, there may be also provided the case in which the functions of the feeders 4 and 5 (having a structure and body 20 thereof supporting the pulley 15 driven by a motor thereof, the speed and tension sensors 17 as well as the "on board" electronic control act on the motor and which is connected to the control unit 10) be unwound by devices separate from each other and not necessarily associated to a single structure (thus defining each feeder as an independent member). For example, autonomous pulleys may be provided for each provided with a motor thereof and cooperating (directly or through the motor thereof) with speed sensor or detector means adapted to detect the speed of feeding the thread to the textile machine, said pulleys being spaced from each other and each being close to a separate thread tension sensor or detector, the entirety not necessarily being combined in a single device. In such case, an electronic control of each single pulley and of the motor thereof may be provided or not or the command and control of the latter may be directly obtained by the control unit 10 which is equally directly connected to the means for detecting the tension of the thread F and the rotational speed of each pulley.

Also such variants shall be deemed falling within the scope of the invention as defined by the claims that follow.

The invention claimed is:

1. A method for feeding, with predefined drawing ratio, a thread to a textile machine, comprising first rotary means actuated by a first actuator thereof, a first speed sensor detecting a first rotational speed of said first rotary means, and a first tension sensor detecting a first tension of the thread, wherein said first rotary means and said first speed sensor and the first tension sensor being arranged in proximity of the textile machine and cooperating with the thread before the thread reaches the textile machine, second rotary means actuated by a second actuator thereof, a second speed sensor detecting a second rotational speed of said second rotary means, and a second tension sensor detecting a second tension of the thread, wherein said second rotary means and said second speed sensor and the second tension sensor are arranged spaced from said first rotary means and said first speed sensor and said first tension sensor, the second rotary means feeding the thread to said first rotary means and being more distant than the first rotary means from the textile machine, said first and second rotary means and said first and second speed sensors and said first and second tension sensors being functionally connected to a control means, said control means controlling the feeding of the thread to the textile machine, and said control means performing a measurement of the first rotational speed of the first rotary means, control of the second rotational speed of said second rotary means and definition of a drawing ratio of the thread sent to the textile machine based on the ratio between the first rotational speed and the second rotational speed, said drawing ratio being maintained equivalent to a predefined value acting on the second rotational speed of the second rotary means.

2. The method according to claim 1, wherein at least said first rotary means feed the thread to the textile machine at a constant tension, the constant tension being tension maintained equivalent to a preset value or setpoint value.

3. The method according to claim 2, wherein the preset value or setpoint value is, alternatively: a) fixed during the operation of the textile machine, or b) variable as a function of the state of progress of such operation.

4. The method according to claim 1, wherein said first rotary means, the first actuator, the first speed sensor and the first tension sensor are part of a first thread feeder and are associated to a body of the first thread feeder, the second rotary means, the second actuator, the second speed sensor and the second tension sensor are part of a second thread feeder and are associated to a body of the second thread feeder, each thread feeder comprising an electronic control thereof connected to the corresponding actuator and to the corresponding speed sensors and tension sensors, said electronic control being connected to the control means, said first and second rotary means being a pulley on which the thread is at least partly wound, the rotational speed of the pulley being controlled through the control of the rotational speed of the corresponding actuators, the rotational speed of the corresponding actuators being used for defining the drawing ratio.

5. The method according to claim 4, wherein the control means calculate a speed ratio of the actuators acting on the respective pulleys for defining the drawing ratio of the thread sent to the textile machine and, if such ratio is different from the predefined value, the control means intervene on the actuator of the second thread feeder to modify the rotational speed of the pulley thereof and make such ratio equivalent to the predefined value of the drawing ratio.

6. The method according to claim 4, wherein both thread feeders feed the thread at a constant tension, the tension applied to the thread by the first thread feeder being maintained constant at a value equivalent to a preset value, the tension applied to the thread by the second feeder being always maintained constant but equivalent to a value calculated to reach the predefined value of the drawing ratio.

7. The method according to claim 4, wherein the tension applied to the thread by the first feeder is alternatively: a)

constant during the entire production cycle, or b) variable as a function of the state of progress of the operation of the textile machine.

8. The method according to claim 5, wherein the control means start calculating the drawing ratio and thus maintaining the drawing ratio constant and equivalent to a preset value upon detecting that the first thread feeder has passed from a stop step to a feeding step, that the textile machine has started demanding the thread to be processed and that the rotational speed of the pulley of the first thread feeder has become different from zero.

9. The method according to claim 5, wherein the second thread feeder feeds the thread at a constant speed, the feeding speed being maintained equivalent to a predefined setpoint, a speed modification of the actuator of the pulley of such second thread feeder being obtained by changing the setpoint value of the speed of the second thread feeder.

10. The method according to claim 1, wherein there is detected a state of operation of the textile machine and operative steps thereof, the drawing ratio being modified as a function of such operative-steps.

11. A system for feeding, with a predefined drawing ratio, a thread to a textile machine, said feeding occurring according to the method according to claim 1, said textile machine comprising first rotary means actuated by a first actuator thereof, a first speed sensor adapted to detect a first rotational speed of said first rotary means and a first tension sensor for detecting a first tension of the thread, the first rotary means and the first speed sensor and the first tension sensor being arranged in proximity of the textile machine and for cooperating with the thread before the thread reaches the textile machine, the second rotary means being actuated by a second actuator thereof and a second speed sensor adapted to detect a second rotational speed of said second rotary means and a second tension sensor for detecting a second tension of the thread, the second rotary means, the second speed sensor, and the second tension sensor being arranged spaced from such first rotary means and first tension sensor and first speed sensor, the second rotary means for feeding the thread to said first rotary means and being more distant than the first rotary means from the textile machine, wherein the first and second rotary means and the first and second speed sensors and first and second tension sensors are connected to a control means for controlling the feeding of the thread to the textile machine adapted to control the drawing ratio of said thread, the control means for performing the measurement of the rotational speed of the first rotary means, the control of the rotational speed of the second rotary means and definition of a drawing ratio of the thread sent to the textile machine based on the ratio between the first rotational speed and the second rotational speed, said drawing ratio being maintained equivalent to a predefined value acting on the rotational speed of the second rotary means.

12. The system according to claim 11, wherein said first rotary means, said first speed sensor and said first tension sensor are part of a first thread feeder having an electronic control thereof connected to such first thread feeder, said second rotary means, said second speed sensor and said second tension sensor being part of a second thread feeder having an electronic control thereof connected to such second thread feeder, wherein the control means comprises a control unit, said thread feeders being connected to the control unit, said control unit being connected to the electronic controls of the first and second thread feeders and intervening on the second rotary means with the aim of controlling and commanding the speed thereof.

13. The system according to claim 12, wherein said control unit is connected to the thread feeders through corresponding serial lines.

14. The system according to claim 12, wherein at least the first thread feeder is a thread feeder at a constant tension.

15. The system according to claim 12, comprising one of the following characteristics:

the drawing ratio varies as a function of various operating steps of the textile machine;

the predefined value is a constant and fixed value over the entire duration of the production cycle of the textile machine;

the second thread feeder is a constant tension feeder; or the second thread feeder is a constant speed feeder.

16. The system according to claim 12, comprising one of the following characteristics:

the control unit is part of one of the two thread feeders;

the control unit is integrated in the textile machine;

the control unit is remote connected, wireless, to the thread feeders and/or to the textile machine;

the control unit and the thread feeders are combined in a single device; or at least one between the control unit and at least one thread feeder provides for a display and a keyboard.

17. The system according to claim 12, wherein said control unit is connected to the textile machine to detect at least the actuation thereof.

18. The system according to claim 12, wherein said control unit is connected to the start and the end of various operative steps thereof.

19. The system according to claim 12, wherein said control unit comprises a microprocessor.

20. A method comprising:

feeding a thread to a textile machine at a predefined drawing ratio, the thread being fed to the textile machine through a first rotary means and a second rotary means;

detecting a first rotational speed of the first rotary means using a first speed sensor;

detecting a first tension of the thread using a first tension sensor;

detecting a second rotational speed of the second rotary means using a second speed sensor;

detecting a second tension of the thread using a second tension sensor;

wherein the first rotary means, the first speed sensor and the first tension sensor cooperate with the thread before the thread reaches the textile machine, and the first rotary means, the first speed sensor and the first tension sensor are spaced apart from the second rotary means, the second speed sensor and the second tension sensor;

wherein the second rotary means is more distant from the textile machine than is the first rotary means, the second rotary means feeding the thread to the first rotary means; and wherein the first and second rotary means, the first and second speed sensors, and the first and second tension sensors are functionally connected to a control means;

controlling the feeding of the thread to the textile machine using the control means, the control means detecting the first rotational speed and the second rotational speed; and controlling the second rotational speed and defining a drawing ratio using the control means, the drawing ratio being based on a ratio between the first rotational speed and the second rotational speed;

wherein the drawing ratio is maintained equivalent to the predefined drawing ratio.

* * * * *